US006481789B1

(12) United States Patent
Ambasz

(10) Patent No.: US 6,481,789 B1
(45) Date of Patent: Nov. 19, 2002

(54) STACKABLE CHAIR

(75) Inventor: Emilio Ambasz, Buenos Aires (AR)

(73) Assignee: Center for Design Research and Development N.V., Curacao (AN)

( * ) Notice: Subject to any disclaimer, the term of this patent is extended or adjusted under 35 U.S.C. 154(b) by 195 days.

(21) Appl. No.: 09/589,331

(22) Filed: Jun. 7, 2000

Related U.S. Application Data

(60) Provisional application No. 60/140,041, filed on Jun. 18, 1999.

(51) Int. Cl.[7] ..... A47C 1/21

(52) U.S. Cl. ..... 297/55; 297/332; 297/354.11

(58) Field of Search ..... 297/55, 291, 292, 297/301.3, 301.5, 331, 332, 333, 354.1, 354.11

(56) References Cited

U.S. PATENT DOCUMENTS

| | | | | | |
|---|---|---|---|---|---|
| 704,109 | A | * | 7/1902 | Richards | 297/291 |
| 1,238,087 | A | * | 8/1917 | Bawtinhimer et al. | 297/333 |
| 1,775,862 | A | * | 9/1930 | Medler et al. | 297/333 |
| 3,705,744 | A | | 12/1972 | Piretti et al. | 297/55 |
| 3,982,785 | A | | 9/1976 | Ambasz | 297/160 |
| 4,793,654 | A | | 12/1988 | Takafuji | 297/338 |
| 4,884,842 | A | * | 12/1989 | Finkelstein | 297/331 |
| 5,524,966 | A | | 6/1996 | Piretti | 297/301.3 |

FOREIGN PATENT DOCUMENTS

| | | |
|---|---|---|
| DE | 19745072 | 6/1987 |
| DE | 3933817 | 11/1990 |
| EP | 0626146 | 5/1994 |
| FR | 2569965 | 3/1986 |
| WO | 0024294 | 5/2000 |

* cited by examiner

*Primary Examiner*—Peter R. Brown
(74) *Attorney, Agent, or Firm*—Baker Botts LLP

(57) ABSTRACT

A stackable chair has a frame with a tubular crosspiece, to each end of which a monolithic casting having legs and a backrest support—and, optionally, an armrest—is attached by means of an integral connecting boss received within the crosspiece and held in place by a connector pin. The backrest supports receive a backrest that pivots between an upright position, to which it is biased by a spring mechanism, and a rearwardly tilted position. The range of tilting motion is limited by a stop pin on the backrest and a stop groove in the backrest support. A seat is mounted on the crosspiece, either in a fixed position or for tilting to an upright position. Chairs with tilting seats include seat supports having diametrically opposite slots that receive projecting portions of the connecting pins. The connector pins slidably engage the sides of the slots to hold the seat supports in place on the crosspiece axially. The ends of the slots engage the connector pins in the down and tilted-up positions of the seat.

23 Claims, 21 Drawing Sheets

STACKABLE CHAIR

REFERENCE TO RELATED APPLICATION

The present application is based on U.S. Provisional Application No. 60/140,041, filed Jun. 18, 1999.

BACKGROUND OF THE INVENTION

Stackable chairs are widely used in institutional and commercial settings of all sorts, such as meeting and conference rooms, auditoriums, multi-purpose assembly halls, and gymnasiums that can be temporarily converted to auditoriums. Stackable chairs occupy a small volume for storage, thus making space in a room available for other purposes.

Most stacking chairs have a fixed backrest, which is comfortable for one sitting posture but uncomfortable for sitting postures other than the one for which it is designed. A chair occupant quickly becomes fatigued if he or she does not change his or her sitting posture from time to time. Chairs with fixed backrests, therefore, are uncomfortable for significant amounts of time for most users.

Stacking chairs commonly have fixed seats. Rows of chairs with fixed seats have to be relative widely spaced in order to allow people to pass easily along the aisles between the rows. Wider spacing of rows reduces the seating capacity for any given space.

BRIEF SUMMARY OF THE INVENTION

An object of the present invention is to provide a stackable chair that is comfortable to sit on in many seating postures, attractive in appearance, highly durable, versatile in use, and economical to produce. A further object is to provide a stackable chair that can be easily and quickly assembled by unskilled assemblers using simple tools, thereby permitting the chair to be shipped in disassembled condition to a point of sale or end use. It is also desired that a stackable chair have a limited number of components that can be used interchangeably to suit the desires and needs of the end user. Still another object is to permit stackable chairs to be arranged in closely spaced rows for high density seating.

The foregoing objects are attained, in accordance with the present invention, by a chair having a frame that includes a crosspiece, a front leg, a rear leg and a backrest support attached to each end of the crosspiece, a seat mounted on the crosspiece, a backrest, and a pair of backrest-mounting mechanisms mounting the backrest on the backrest supports for pivotal movement about a horizontal pivot axis between an upright and a rearwardly inclined position. Each backrest-mounting mechanism attaches one side of the backrest to the backrest support and includes a pivot pin attaching the backrest to the backrest support for pivotal movement, a spring engaged between the backrest and the backrest support and biasing the backrest to an upright position, and a stop pin affixed to one of the backrest and the backrest support and received in a stop groove in the other of the backrest and the backrest support. The stop pin is engageable with end stop surfaces of the stop groove so as to limit the range of pivotal movement of the backrest and establish the upright and inclined positions of the backrest.

As is well-known per se, the mounting of a backrest of a chair for pivotal movement enables the backrest to assume any position between upright and significantly tilted back in response to the forces applied to it by the anatomical back of a person sitting in the chair so as to comfortably support the sitter's back. The backrest mounting members of a chair embodying the present invention is of simple construction, easily installed, inexpensive, durable, and requires little space. Advantageously, the spring is a coil torsion spring having a coil and projecting leg at each end of the coil, the coil being received around the pivot pin, one leg being received in a cavity in the backrest and the other leg being received in a cavity in the backrest support. In addition, the cavity in the backrest is in a laterally outwardly facing surface of the backrest and the cavity in the backrest support is in an inwardly facing surface of the backrest support abreast of the outwardly facing surface of the backrest support. Thus, the backrest mounting member is concealed from view.

It is preferred for the stop pin to be affixed to the backrest and the stop groove to be formed in the backrest support. The groove requires more space than the stop pin and is best provided in the backrest support, whereas the stop pin is readily supported in the backrest without requiring undue enlargement of the region of installation. To facilitate installation of the stop pin, the backrest support has a hole opening into the stop groove and aligned with a hole in the backrest that receives the stop pin so that the stop pin can be installed from the lateral (outer) side of the backrest support.

In preferred embodiments of a chair according to the present invention, the seat is affixed to a pair of laterally spaced-apart seat supports mounted on the crosspiece. The seat supports may be affixed to the crosspiece or they may be pivotally mounted on the crosspiece so that the seat can be tilted up. In advantageous constructions, the crosspiece is tubular, and at least the front leg and the backrest support at each end of the crosspiece are portions of a monolithic casting of a metal, preferably aluminum. Each casting includes an integral mounting boss that is received within an end portion of the crosspiece. The mounting boss of each casting extends endwise into and is affixed within the crosspiece by a connector pin that extends through mating holes in the crosspiece and the mounting boss. Such an arrangement facilitates manufacture and assembly of the chair frame, uses space efficiently, and is strong. Each casting may also include the rear leg. It is also possible, however, to have separate rear legs and attach them to the castings that include the front legs and the back supports. It is desirable for the mounting boss of each casting to include an axial rib that is received within a slot in the crosspiece so as to attain the proper rotational positioning of the boss in the crosspiece and further affix the casting to the crosspiece against rotation.

In addition to affixing the frame casting to the crosspiece, the connector pin preferably retains the corresponding seat support seat in the proper axial position on the crosspiece and serves as a stop for setting the down and tilted up positions of the seat. To those ends, the connector pin extends completely through the crosspiece and includes portions projecting outwardly from opposite sides of the crosspiece. The projecting portions are received in stop slots in the seat support, are in sliding engagement with side surfaces of the stop slots to retain the seat support on the crosspiece against lateral movement (axially along the crosspiece) and are engageable with end stop surfaces of the stop slots so as to establish the up and down positions of the seat supports. The affixation of each frame casting and seat support and the stop function for the seat tilt-up feature are accomplished with a single element—the connector pin—which is inexpensive, occupies little space and is easily installed.

Many users of chairs embodying the invention will be content to have chairs in which the seat is tilted up and down manually. Other users will find it to be desirable for the seat to tilt up automatically whenever no one is sitting in it, thus leaving aisles between rows of chairs free of obstruction by seats left tilted down. The latter users' wishes are fulfilled, according to another aspect of the present invention, by coupling a spring between the crosspiece and at least one—and preferably both—of the seat supports to bias the seat to pivot to the tilted-up position. For example, a simple tension coil spring coupled between the connector pin and the seat support can be provided to bias the seat to the tilted up position.

The chairs of the present invention are designed to be stacked with the seat in the down position. To facilitate stacking of chairs with automatic seat-tilting arrangements, one of the seat supports may be provided with a lock pin mechanism for locking the seat in a down position. In an advantageous design the lock pin is normally held extended by a spring in a release position. The lock pin may be received in a tubular boss on a flange portion of the seat support and be movable into a hole in the crosspiece to lock the seat in a down position. The forces of the seat tilt-up springs on the seat supports act through the lock pin, which is thereby captured by friction in the hole in the crosspiece. With such a construction of the lock pin mechanism, a downward force on the seat eliminates the friction engagement of the lock pin, which pops out and releases the seat so that it automatically tilts up.

DESCRIPTION OF THE DRAWINGS

For a more complete understanding of the present invention, and additional features and other advantages thereof, reference may be made to the following written description of an exemplary embodiment, taken in conjunction with the accompanying drawings.

FIG. 20—left side elevational;

FIG. 21—bottom plan;

FIG. 22—top plan;

FIG. 23—front elevational;

FIG. 24—end sectional (enlarged) at lines 24—24 of FIG. 20;

FIG. 25—end sectional at lines 25—25 of FIG. 20;

FIG. 26—side sectional at lines 26—26 of FIG. 22;

DESCRIPTION OF THE EMBODIMENTS

Figure 1:
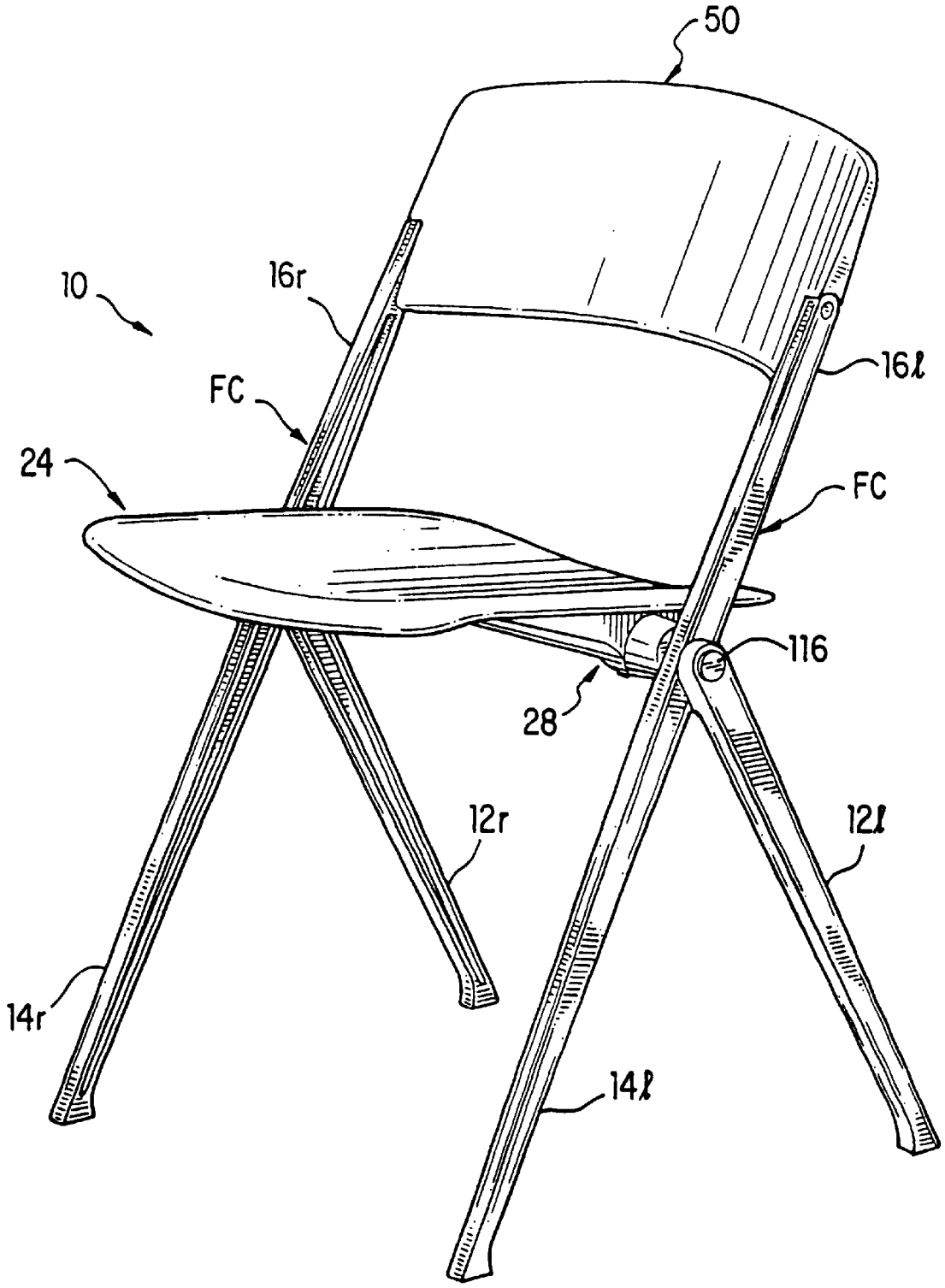
FIG. 1 is a three-quarter front pictorial view of a version of the embodiment with an automatic tilt-up seat and without arms, showing the seat in the "down" position.
Figure 2:
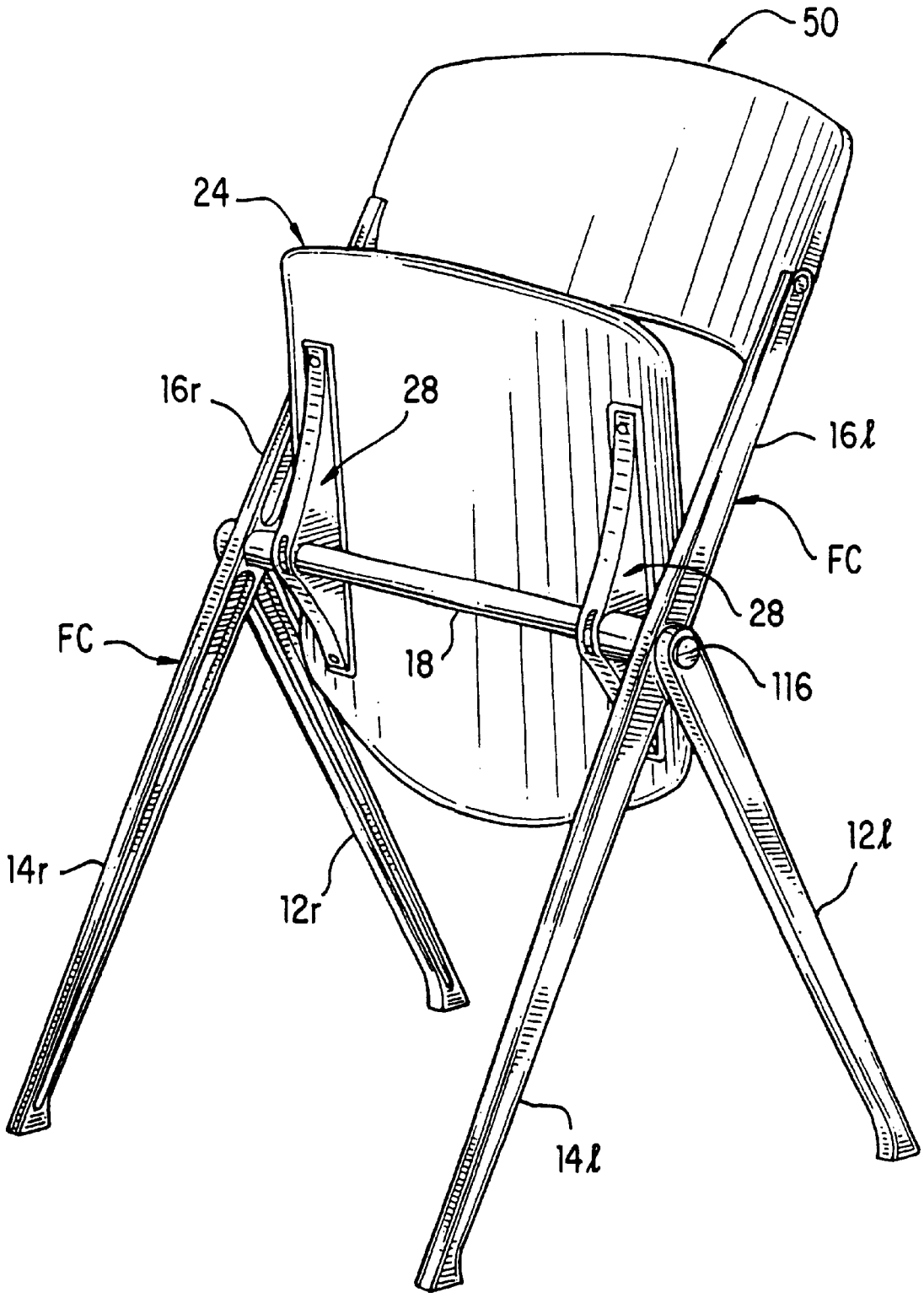
FIG. 2 is a three-quarter front pictorial view of the version of FIG. 1, showing the seat in the "up" position.
Figure 3:
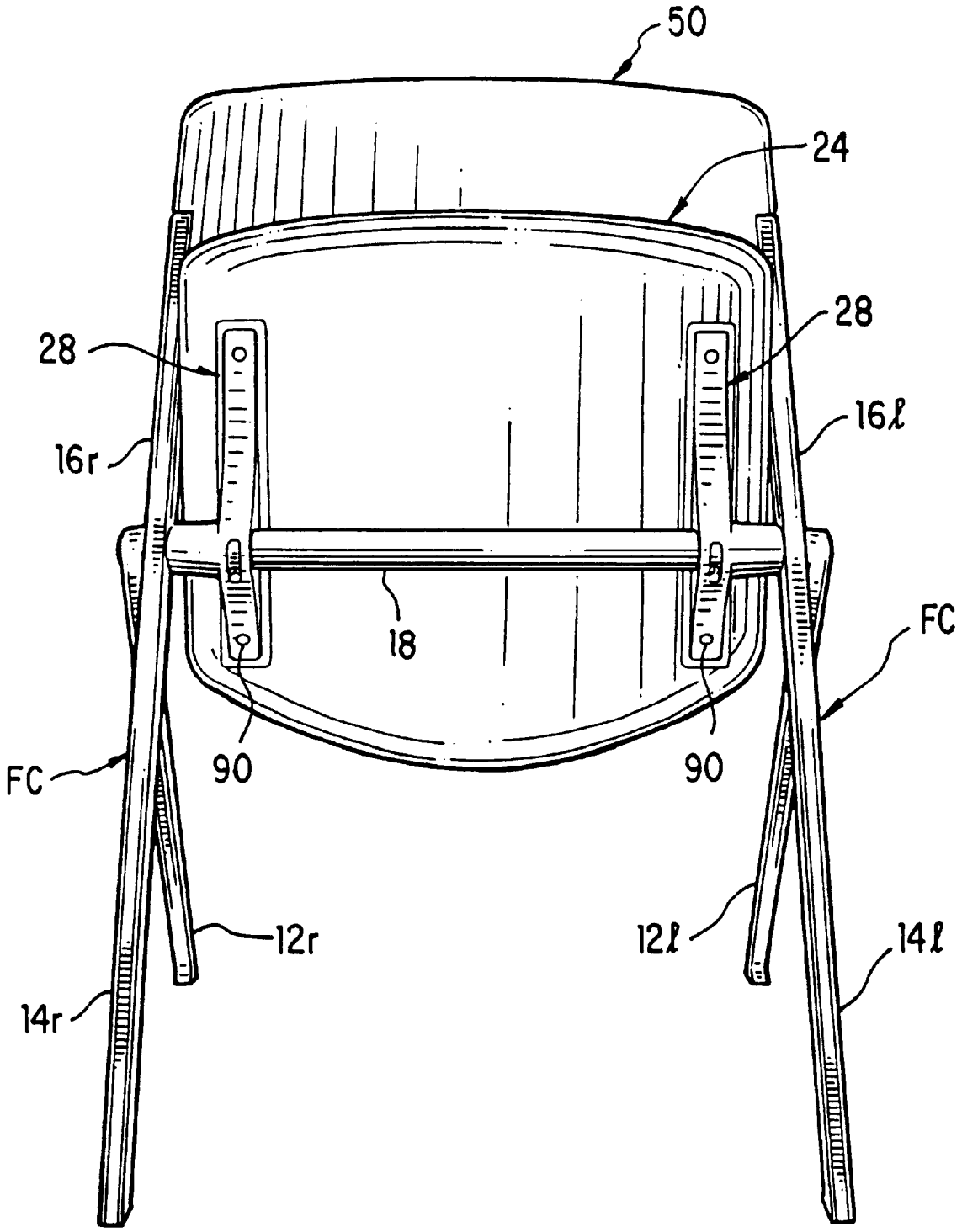
FIG. 3 is a front elevational view of the version of FIG. 1 and 2.

The frame 10 of the armless version shown in FIGS. 1 to 3 consists of right and left rear legs 12*r* and 12*l*, right and left front legs 14*r* and 14*l*, and right and left backrest supports 16*r* and 16*l*. The right legs 12*r* and 14*r* and the right backrest support 16*r* are portions of a monolithic casting of aluminum and are joined to the right end of a crosspiece 18, which is a plain steel tube cut to length and having holes and slots (described below). Likewise, the left legs 12*r* and 14*r* and the left backrest support 16*r* are portions of a monolithic casting of aluminum and are joined to the left end of the crosspiece 18. For simplicity of expression, the castings that provide the legs and backrest supports (and arms, see below) will generally be referred to hereinafter as "frame castings" and are labeled as FC. The right and left frame FCs are the same except for hand.

Figure 4:
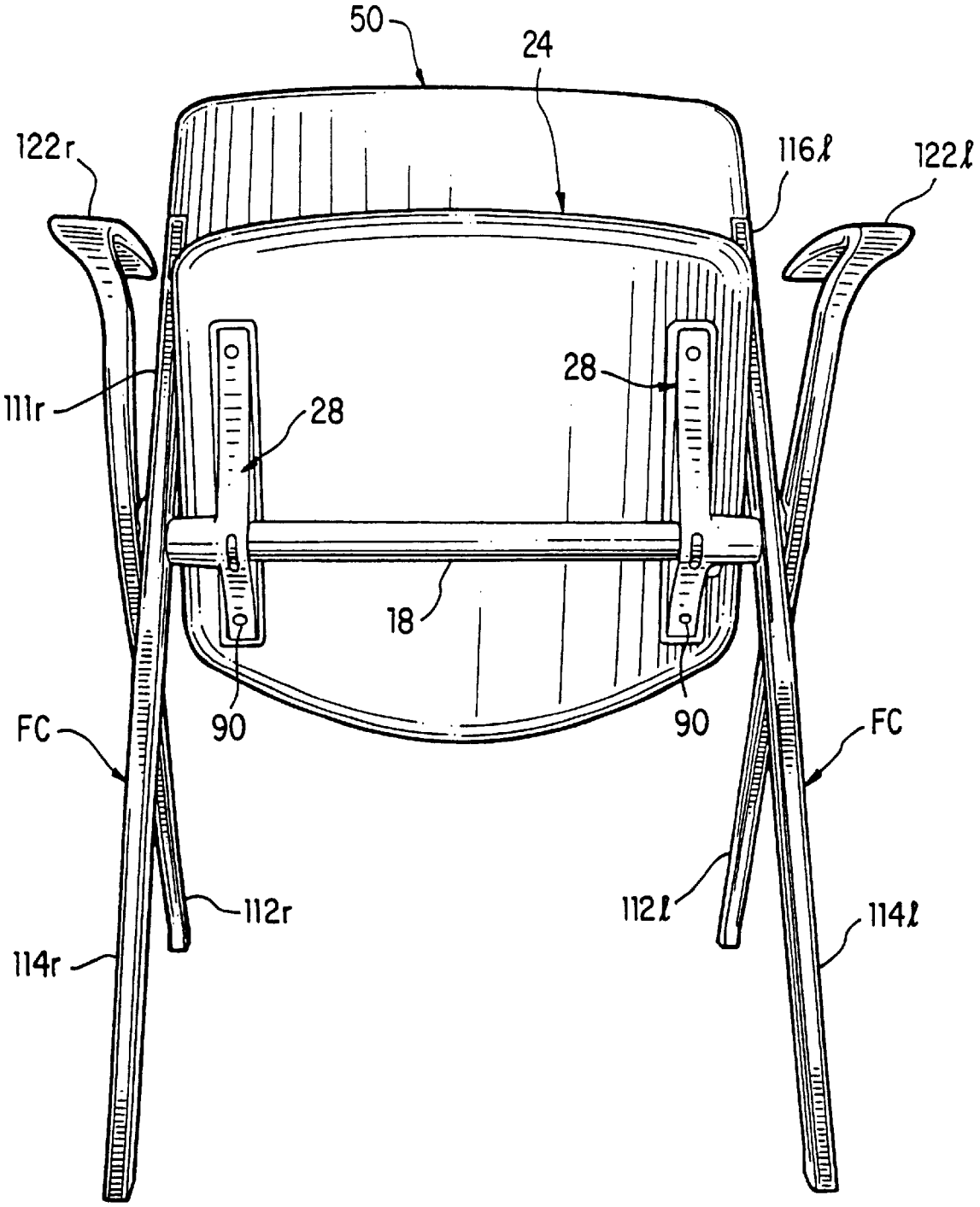
FIG. 4. is a left side elevational view of the version of FIGS. 1 to 3, showing the seat in the down position.
Figure 5:
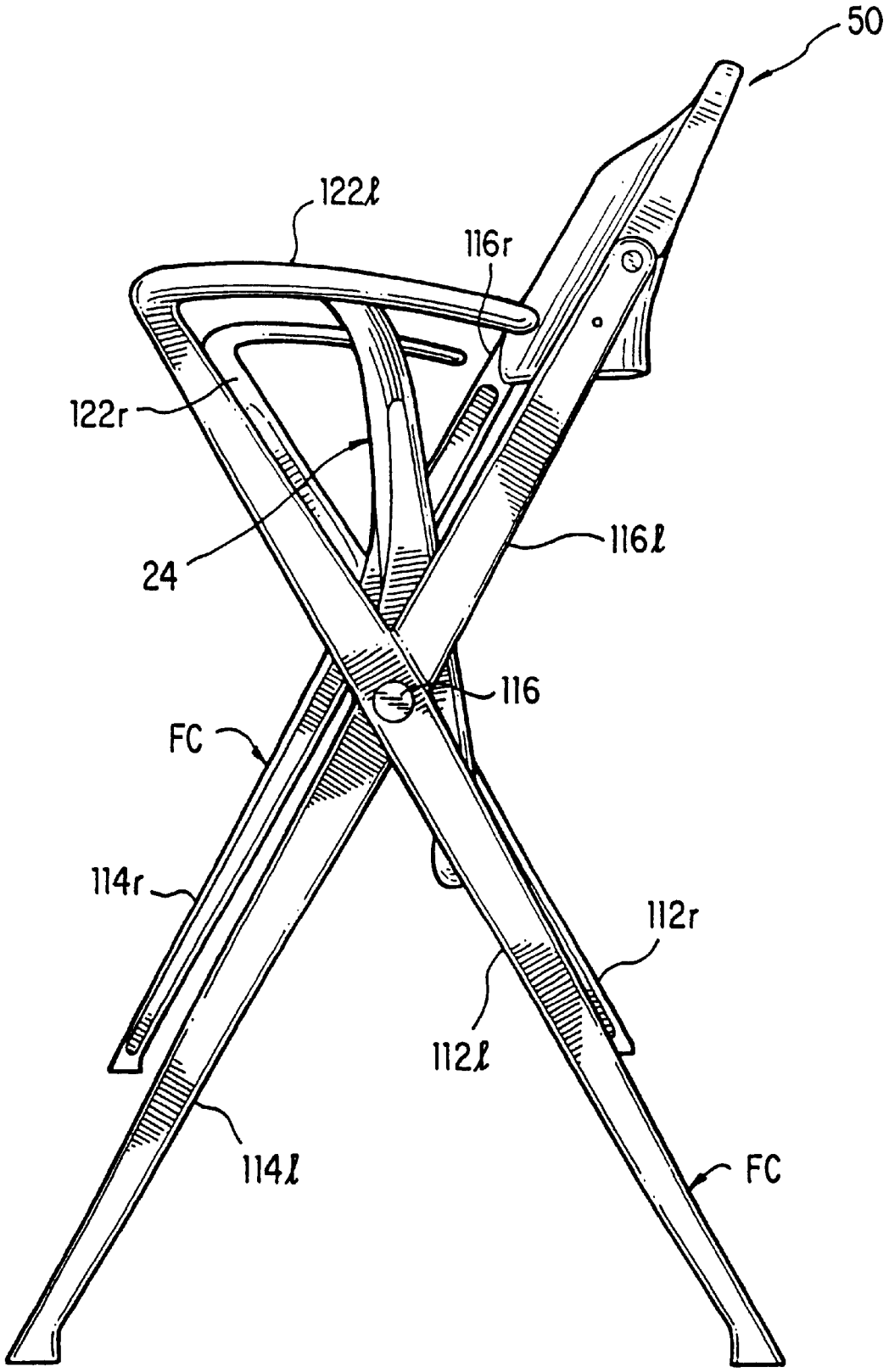
FIG. 5 is a right side elevational view of a version with arms, showing the seat in the up position.

A version with arms, as shown in FIGS. 4 and 5, is the same as the armless version, the only difference being that right and left armrests 122*r* and 122*l* are formed integrally with the respective right and left frame castings FC. The arm versions do not stack, but it is, of course, useful to be able to stack armless versions on versions with arms. A user may want to have a mix of arm and armless versions and can stack one or more armless versions on each arm version.

A seat 24, which may be of metal, molded plastic, a composite material, or any other suitable material, is supported on the crosspiece 18 by a pair of seat supports 26 and 28, which are pivotally received on the crosspiece so that the seat can tilt up. The tilt feature allows persons sitting in a row of chairs to stand up, manually raise the seat (or allow it to lift up automatically, as described below), move to the back of the aisle between rows of chairs, and allow other persons to move more easily along the aisle. The seats are preferably tilted up when the chairs are not occupied so that people can readily move along the aisles. The tilting-seat feature allows rows of chairs to be placed closer together than rows of chairs with fixed seats. Nonetheless, versions of the chair with fixed seats are provided, as described below. The seat supports 26 and 28 in the version of FIGS. 1 to 5 are of cast aluminum. Except as described below, both seat supports 26 and 28 are the same except for hand. Both of the seat supports 26 and 28 have springs that pivot the seat to the up position automatically except when someone is sitting on it or when it is locked down, as described below. It suffices, therefore, to describe the left seat support 28, which is shown in FIGS. 6 to 10.

The seat support 28 has an elongated channel-shaped front support arm 28*f*, an elongated channel-shaped rear support arm 28*r*, each with side and bottom walls that form an upwardly open cavity, and a tubular boss/flange portion 28*b* with a hole 28*h* that receives the crosspiece 18 within it with a sliding fit so that the seat support 28 can pivot about the axis of the crosspiece 18. A connector pin 30 passes through holes in the wall of the crosspiece 18. The lower end portion of the connector pin 30 is a reduced diameter, thus presenting a shoulder for stopping the pin at a predetermined position in the holes in the crosspiece. The boss/flange portion 26*b* of the seat support 28 has slots 38 and 40 that receive the pin 30. The pin 30 has portions that project out from the crosspiece 18. The pin 30 slidably engages the side walls of the slots 38 and 40 to hold the seat support in position on the crosspiece axially. The ends of the slots serve as stops for the seat support 28 by engaging the pin in the up and down positions.

Figure 28:
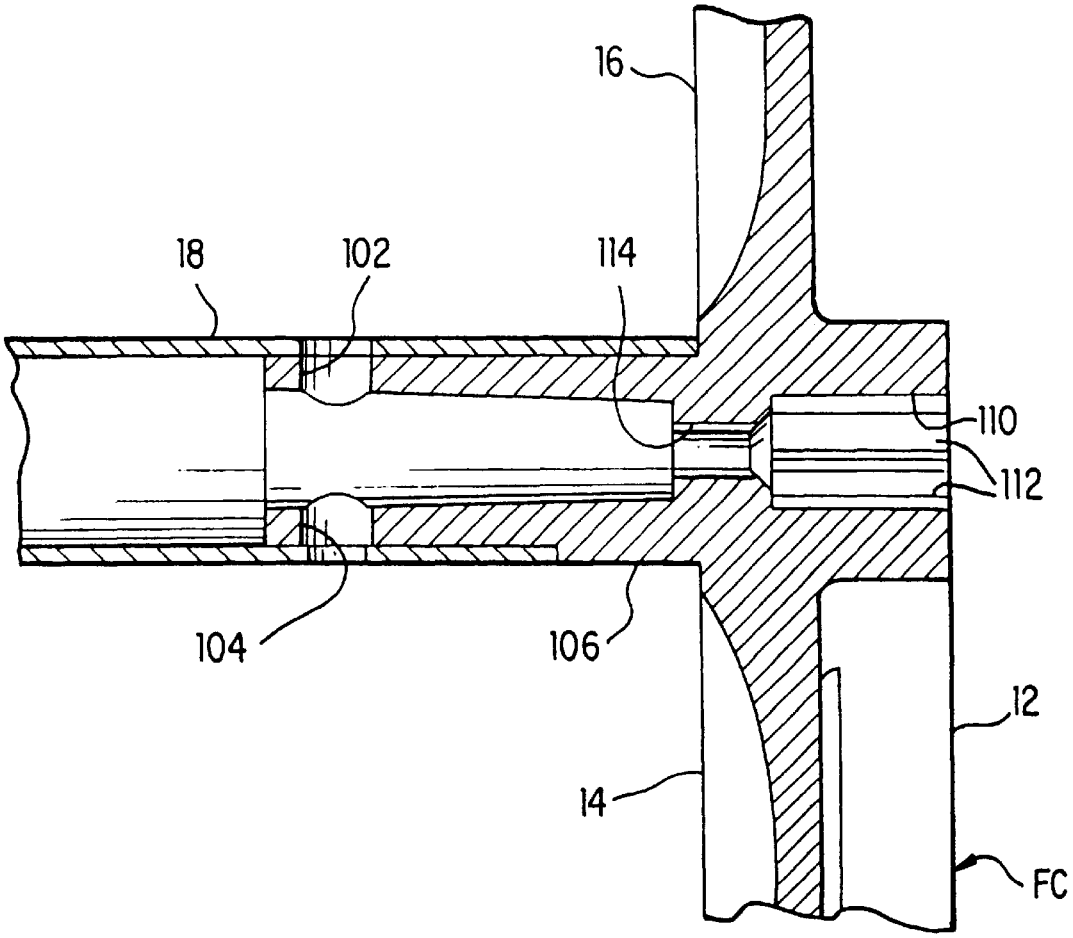
FIG. 28 is a partial cross-sectional view showing the connection between the crosspiece and the left leg/backrest support casting.

The connector pin 30 also affixes the frame castings FC to the crosspiece 18, as described below and shown in FIG. 28.

One end of a tension coil spring 32 is hooked to a lug 34 on the arm 28*f* and the other end to the pin 30. The spring biases the seat to the up position, which is shown in phantom lines in FIG. 8.

One of the seat supports, e.g., the left one 28, has a lock pin mechanism (see FIGS. 9 and 10) on the upper rear aspect of the flange portion of the boss/flange 28*b* where it is ordinarily not visible. A tubular boss 40 on the boss/flange receives a lock pin 42 for sliding movement, which is normally held extended by a spring 44 in a stop position established by a stop pin 46 received in a stop slot 48 in the boss. The lock pin mechanism holds the seat in the down position for stacking of the chairs. A worker holds the seat down and presses in the lock pin, which moves into a hole in the crosspiece 18 (FIG. 10), and then releases the seat while still depressing the lock pin. The forces of the tilt-up springs 32 (FIGS. 7 and 8) on the seat supports 26 and 28 act through the lock pin 42, which is thereby captured by friction in the hole in the-crosspiece 18. With the seat locked down, the worker can stack the chair. When the chair is replaced for use and the front of the seat is pushed down, which may not occur until someone sits on it, thus releasing the force of the tilt-up springs 32 and eliminating the friction force holding the lock pin 42 in the locked position, the lock pin 42 pops out under the force of the spring 44. Thereafter the seat automatically lifts up whenever no force is applied to it to hold it down.

A backrest 50, which will usually be of the same material as the seat 24, is mounted on the backrest supports 16*r* and 16*l* for pivotal movement between an upright position and a tilted-back position, which makes the chair comfortable to various sitting postures between sitting upright and reclining somewhat backwardly and slumping down and forward on the seat 24. A spring mechanism biases the backrest 50 to the upright position, and a stop mechanism limits the extent of movement of the backrest between upright and tilted-back. The spring and stop mechanisms associated with both armrest supports are the same except for hand. The following description of the left mechanisms is applicable to both.

Figure 11:
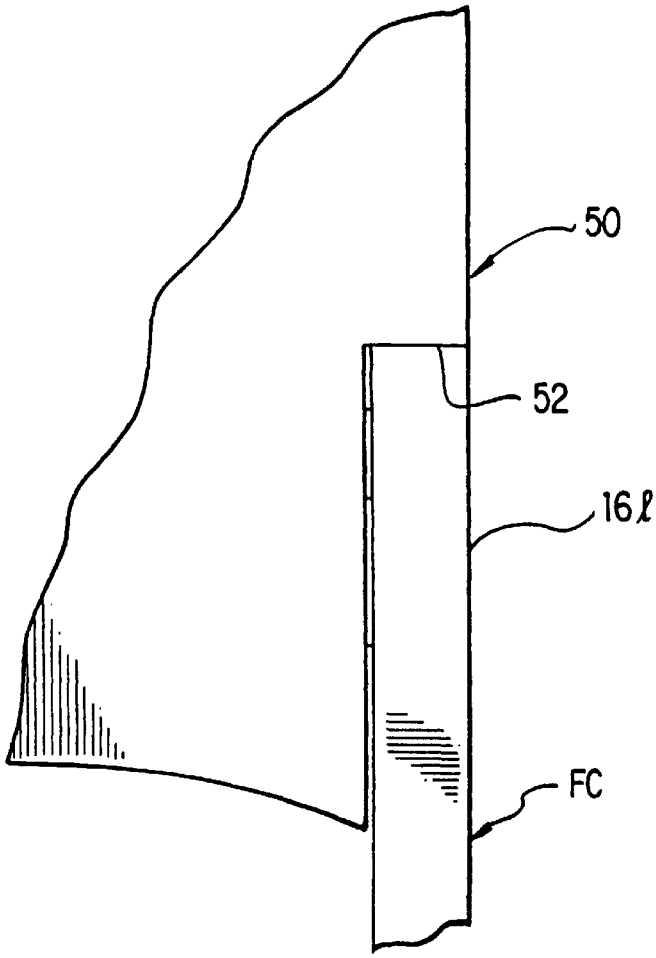
FIG. 11 is a fragmentary front elevational view of the lower left portion of the backrest and the upper end of the left backrest support.
Figure 12:
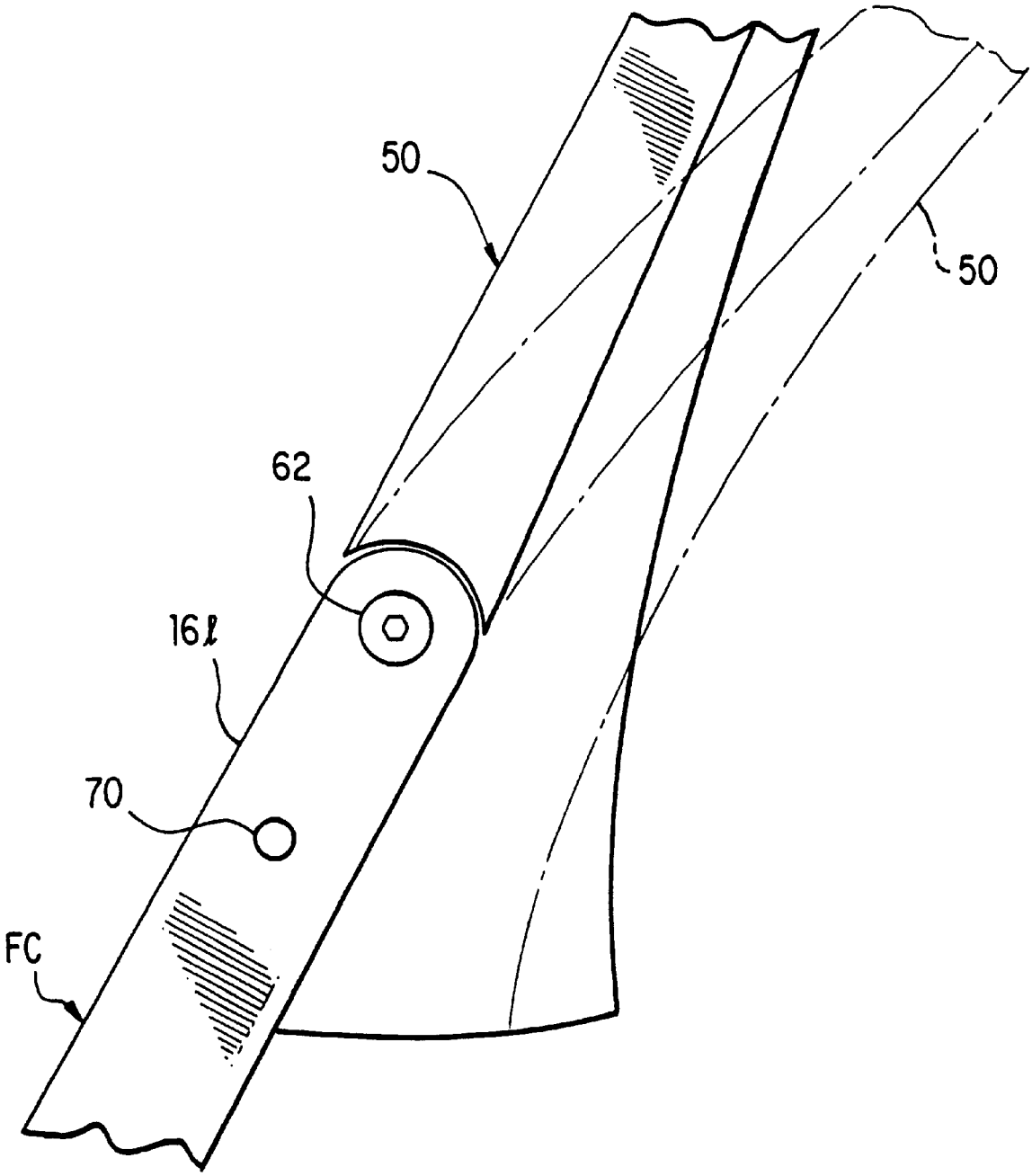
FIG. 12 is a fragmentary side elevational view of the lower left portion of the backrest and the upper end of the backrest support.
Figure 13:
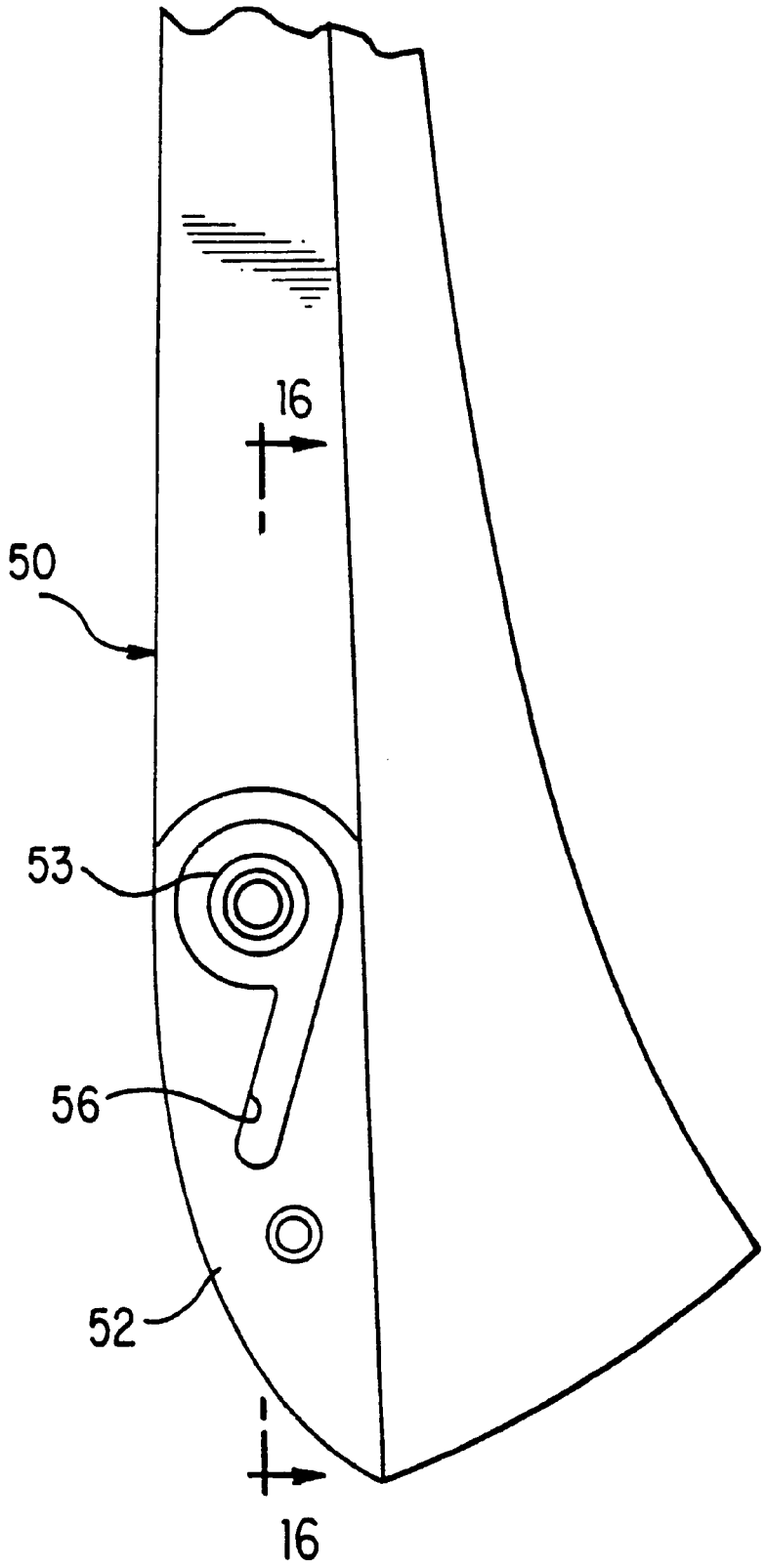
FIG. 13 is a side elevational view of the lower portion of the left side of the backrest (the lateral aspect), and is a mirror image of the right side.
Figure 14:
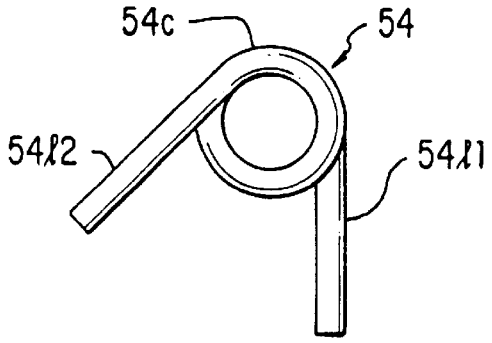
FIG. 14 is a side view of a torsion spring for the backrest tilt mechanism.
Figure 16:
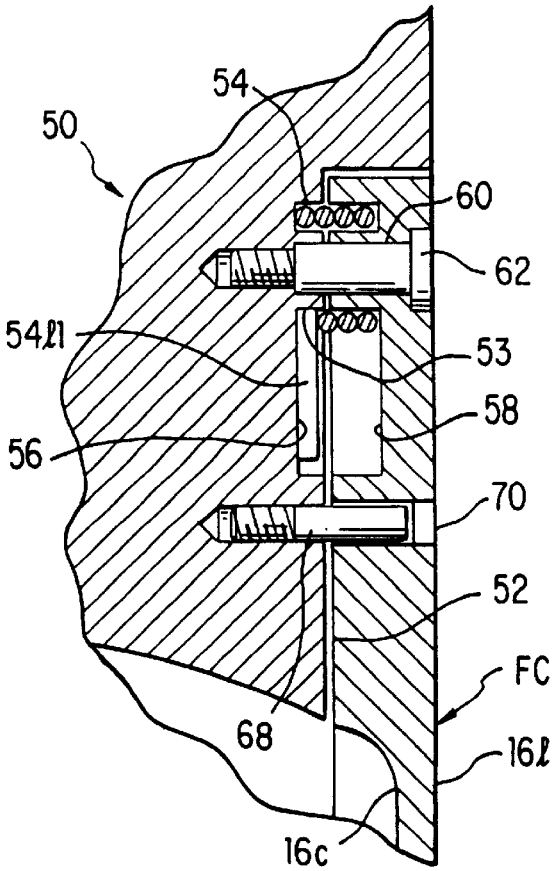
FIG. 16 is a partial front cross-sectional view of the backrest tilt/stop mechanism, taken along the lines 16—16 of FIG. 13.
Figure 15:
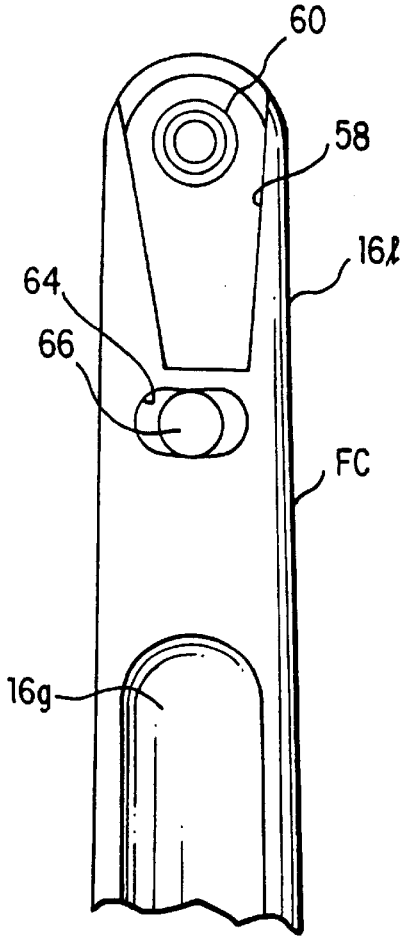
FIG. 15 is a partial side elevational view of the aspect of the upper end of the backrest support that faces towards -he backrest (the medial aspect)

Each lower corner of the backrest 50 has a notch 52, which receives the upper end of the backrest support 16*l* (FIGS. 11 and 12). One leg 54 *l*1 of a torsion spring 54 and part of one loop of the coil 54*c* of the spring 54 are received in a groove 56 in a lateral wall of the backrest support 16 that forms the notch 52 (FIGS. 13 and 16). The coil 54*c* is held in place by a tubular boss 53 on the backrest 50. The medial (inner) face of the upper end of the backrest support 16*l* (FIG. 15) has a cavity 58 that accepts the other leg 54*l*2 and the remaining coils 54*c* of the spring, a tubular boss 60 holding the coils 54*c* in place. A pivot pin 62 having a smooth shank passes through a hole in the backrest support 16 and is secured to the backrest 50 by threads on the end (FIG. 16). The force of the spring 54 biases the backrest to the upright position. The spring yields to the force of the back of a person sitting in the chair when the person leans back, whereupon the backrest pivots to a tilted-back position about the pivot pin 62.

The medial (inner) face of the upper end of the backrest support 16 has an arcuate stop groove 64 (see FIG. 15), the center of curvature of which is the axis of the pivot pin 62. A hole 66 through the bottom wall of the groove and opening at the lateral face of the back support permits a stop pin 68 to be inserted from the lateral side of the backrest support 16 into the groove 64 and affixed to the backrest 50 by threading it into a hole in the backrest. After the stop pin 68 is installed, a plug 70 is pressed into the hole 66 for good appearance. The stop pin 68 pivots with the backrest 50 about the pivot pin 62 to the extent permitted by the opposite ends of the groove 64. Engagement of the stop pin 68 with either end of the groove 64 stops the pivotal movement of the backrest.

Figure 17:
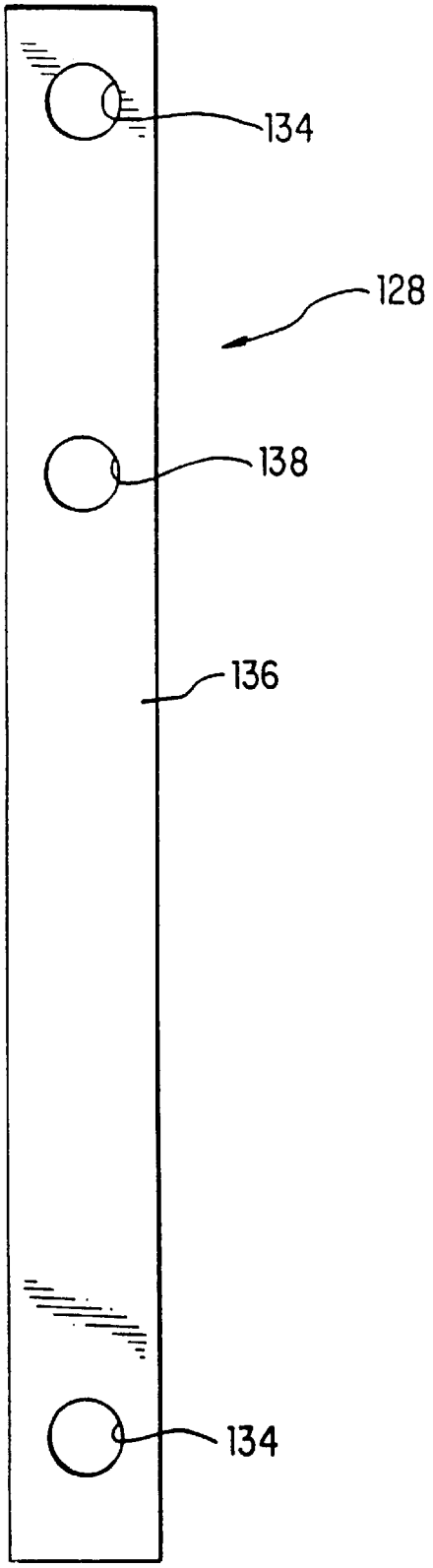
FIG. 17 is a top plan view of a seat support used to mount the seat in a version of the chair in which the seat is fixed.
Figure 18:
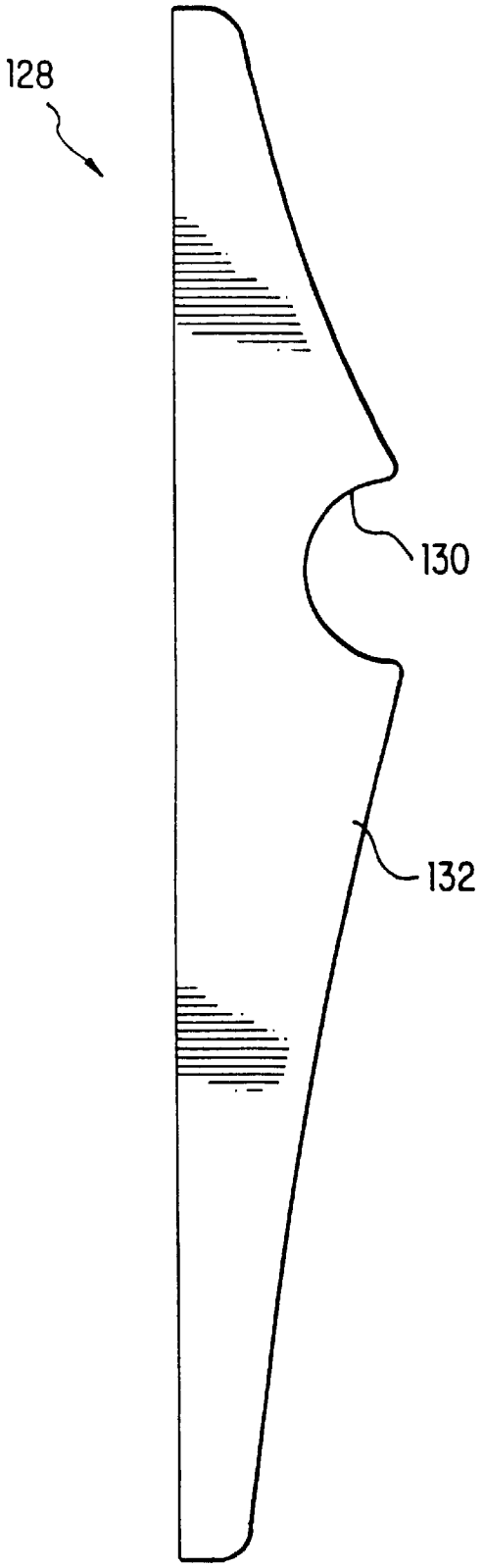
FIG. 18 is a left side elevational view of the seat support or FIG. 17 and is a mirror image of the right side.
Figure 19:
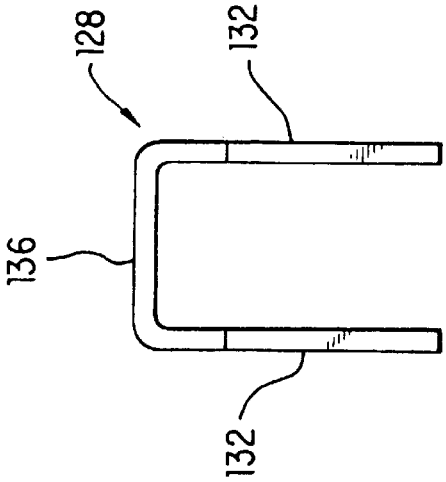
FIG. 19 is a front elevational view of the seat support of FIGS. 17 and 18.
Figure 20:
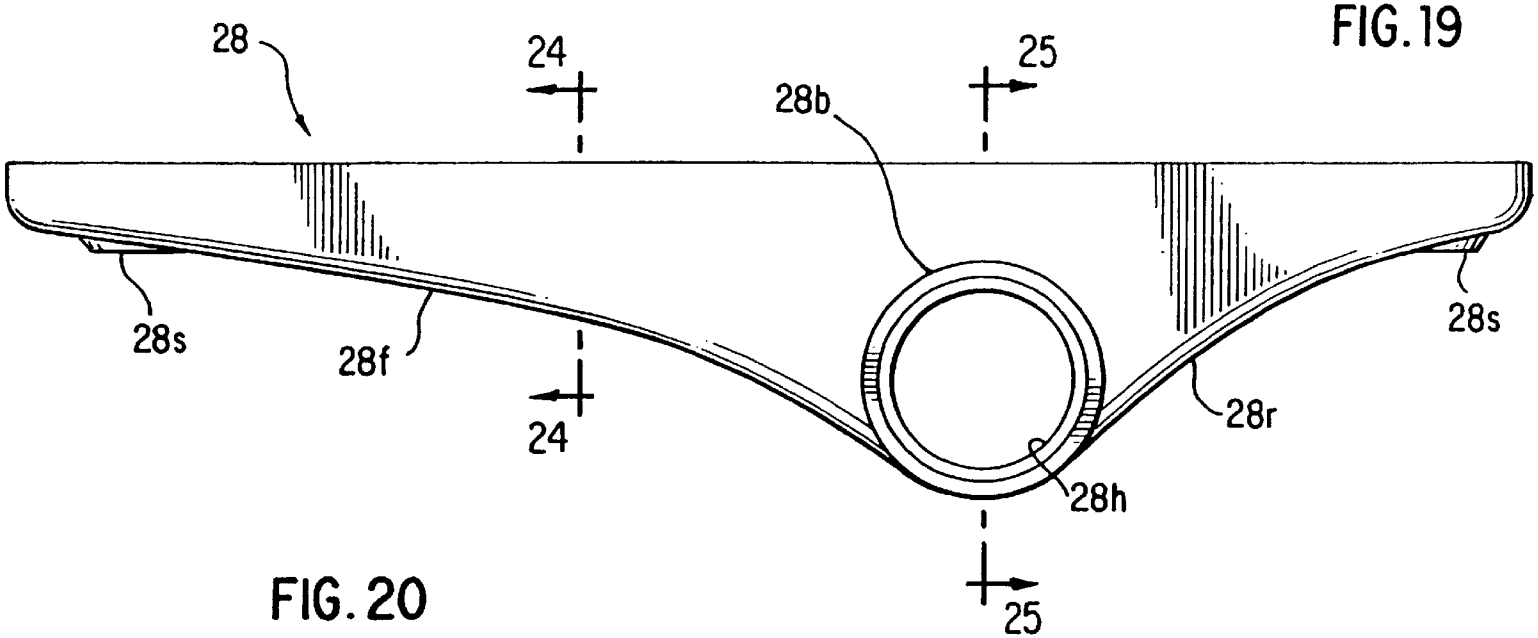
FIGS. 20 to 26 are views, as follows, of a left seat support configured for versions of the chair in which the seat tilts up—the right seat support is the same except for the location of the flange portion.
Figure 21:
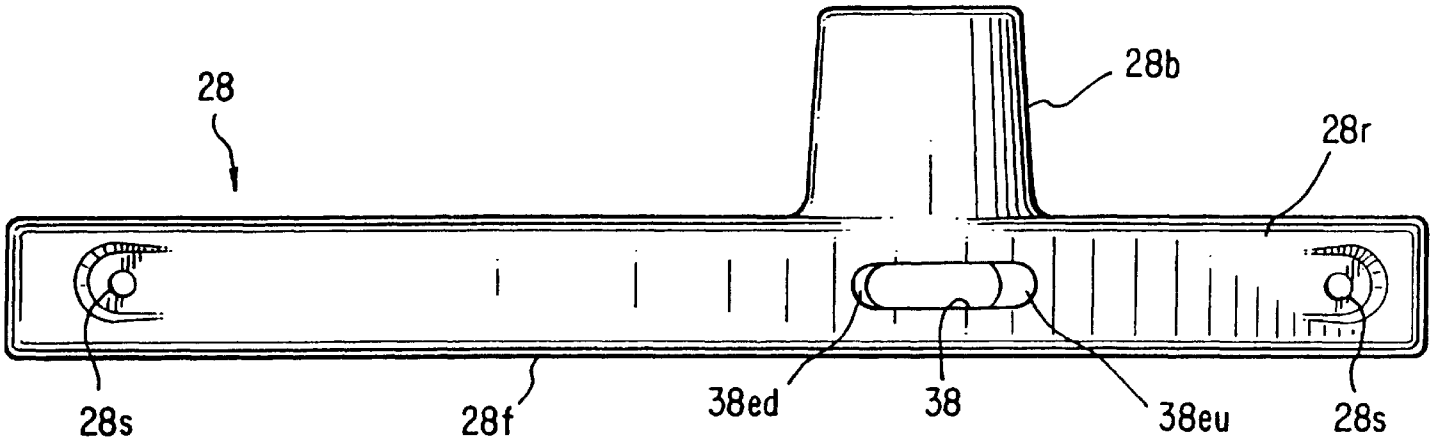
Figure 22:
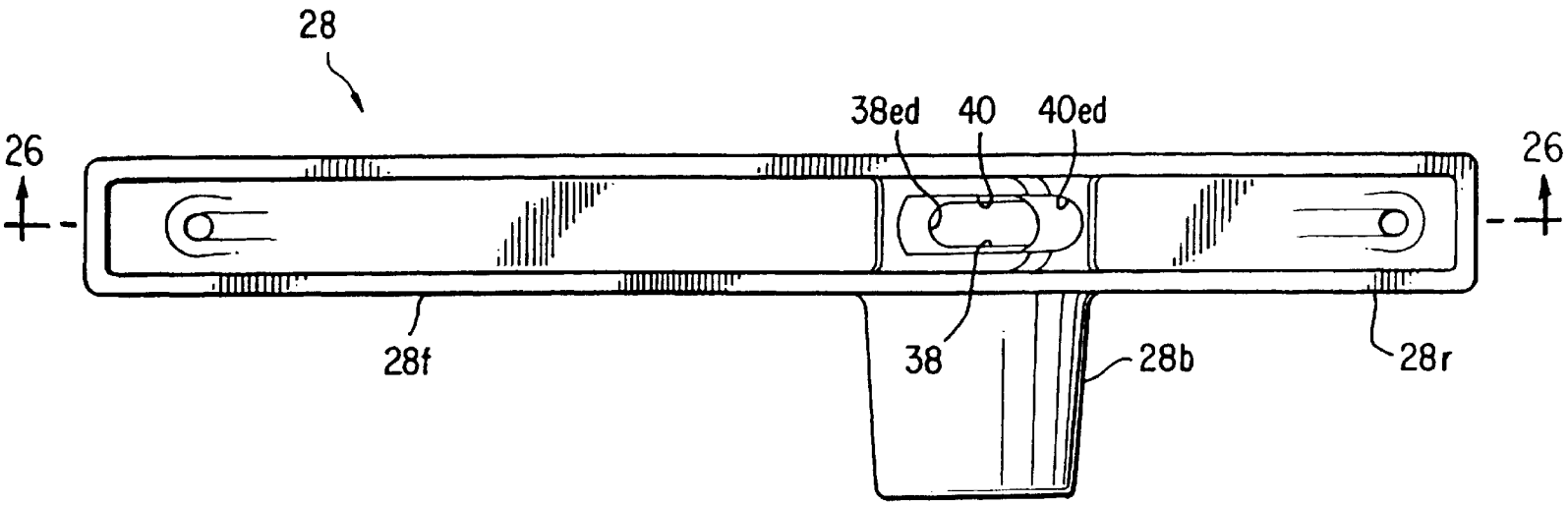
Figure 23:
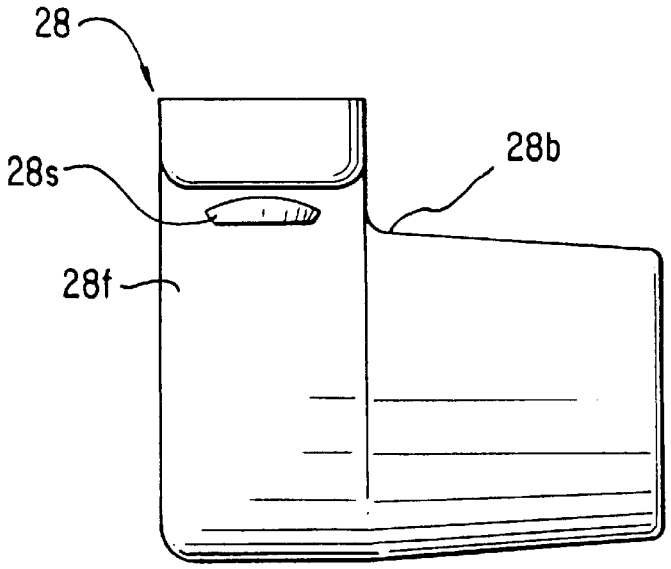
Figure 24:
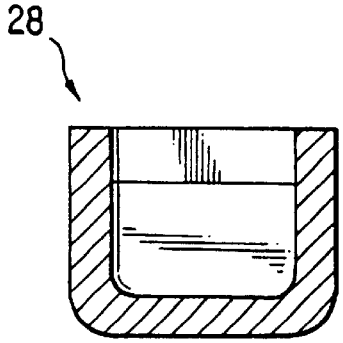
Figure 25:
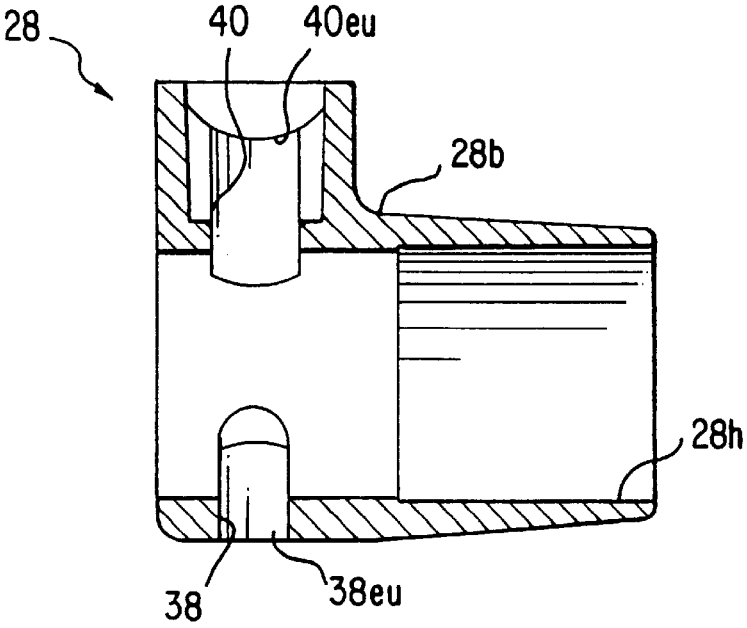
Figure 26:
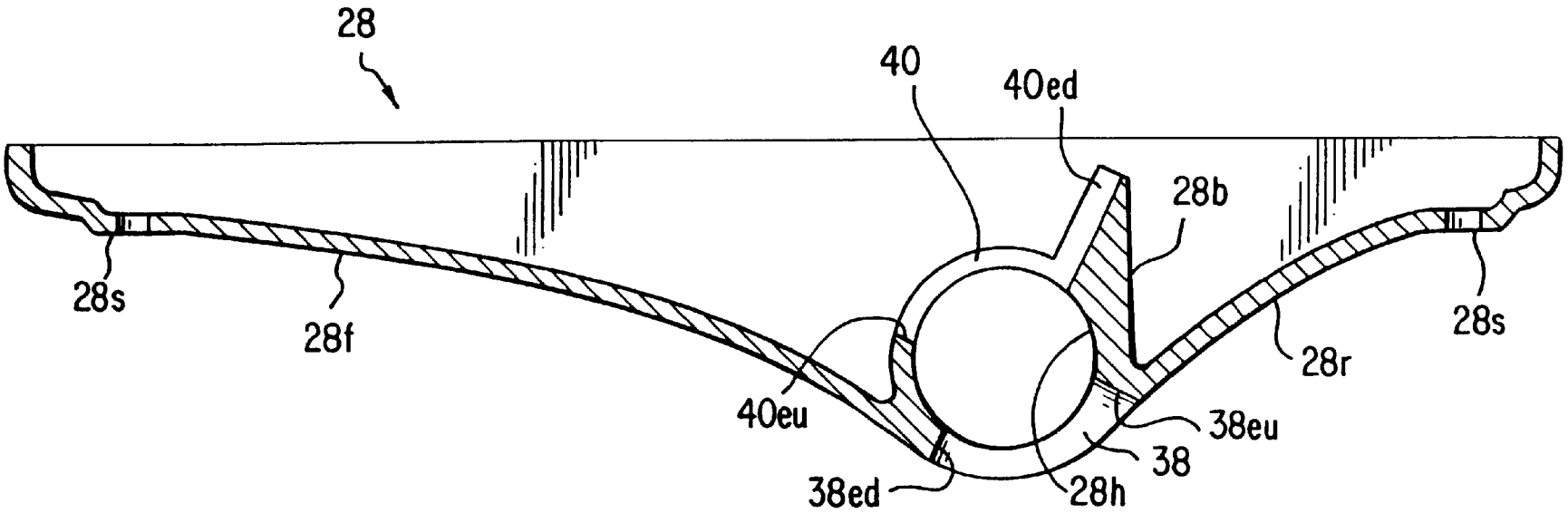

As mentioned above, the chair may have a fixed seat rather than a tilt-up seat. In that case, the seat supports 128 shown in FIGS. 17 to 19 are used in place of the seat supports 28 described above. The seat supports 128 are stamped and bent from sheet metal to form a channel-shaped part similar in lateral profile to that of the seat supports 28. Semicircular notches 130 in side flanges 132 mate with the crosspiece 18. The seat support 128 is welded to the crosspiece 18 in the same locations as the tilt-up seat supports. Holes 134 in the base 136 accept screws for fastening the seat to the seat supports. A hole 138 in the base 136 allows the connector pin 30 to be installed.

Figure 6:
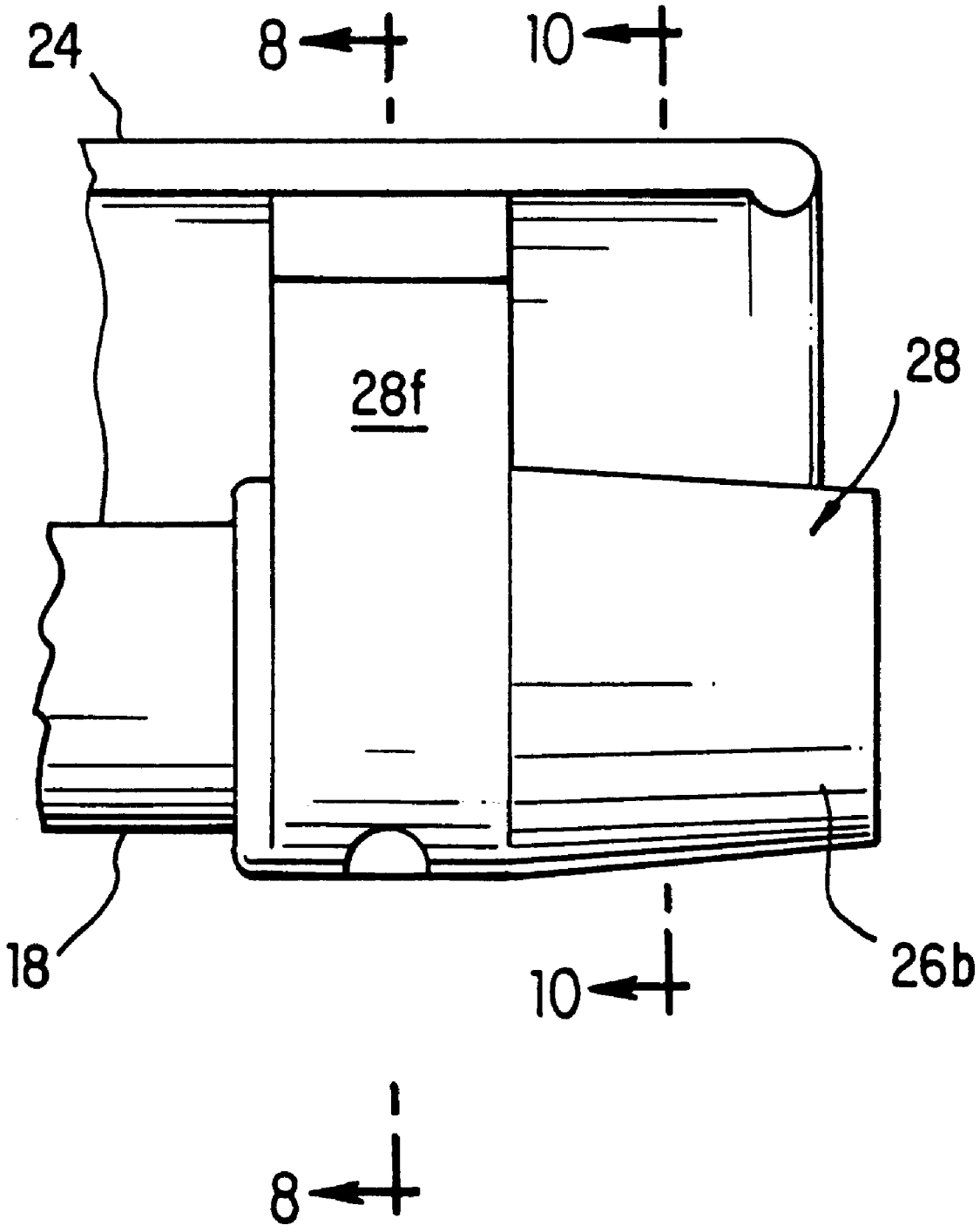
FIG. 6 is a fragmentary front elevational view of the left side seat support and portions of the seat and the frame crosspiece.
Figure 7:
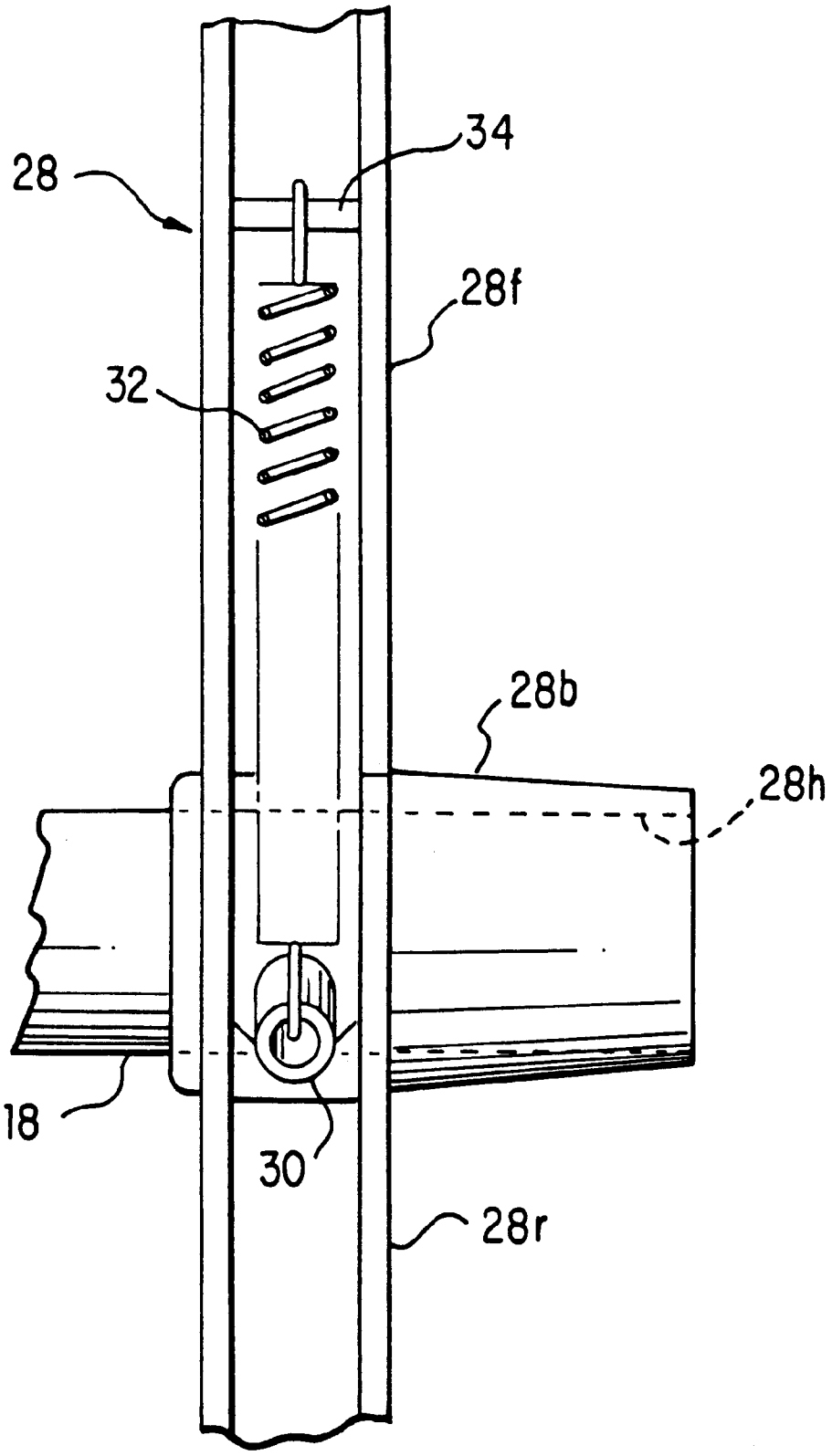
FIG. 7 is a fragmentary top plan view of the left side seat support, showing the seat removed, and a portion of the crosspiece.
Figure 8:
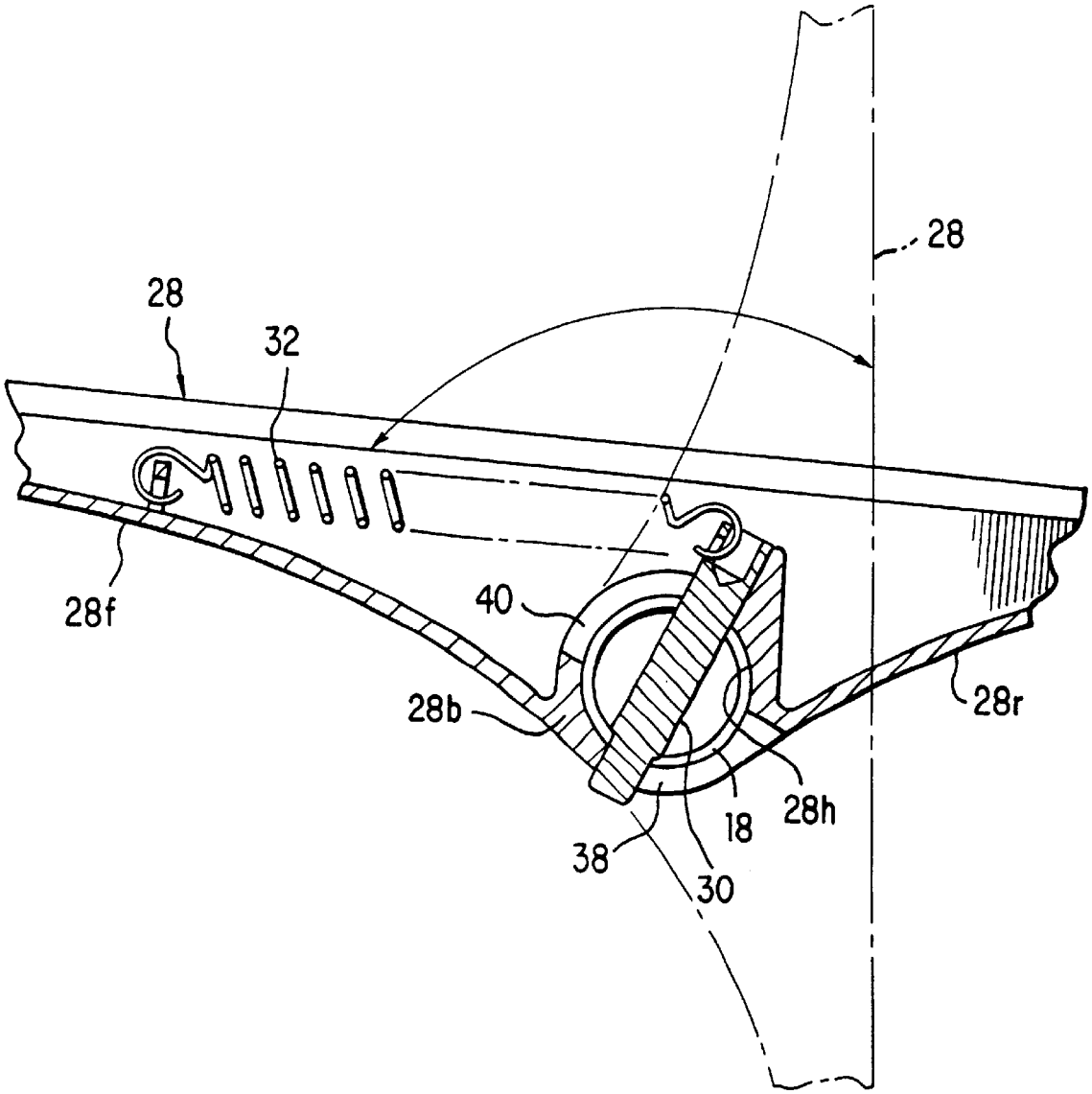
FIG. 8 is a partial side cross-sectional view of the left side seat support, taken along the lines 8—8 of FIG. 6.
Figure 9:
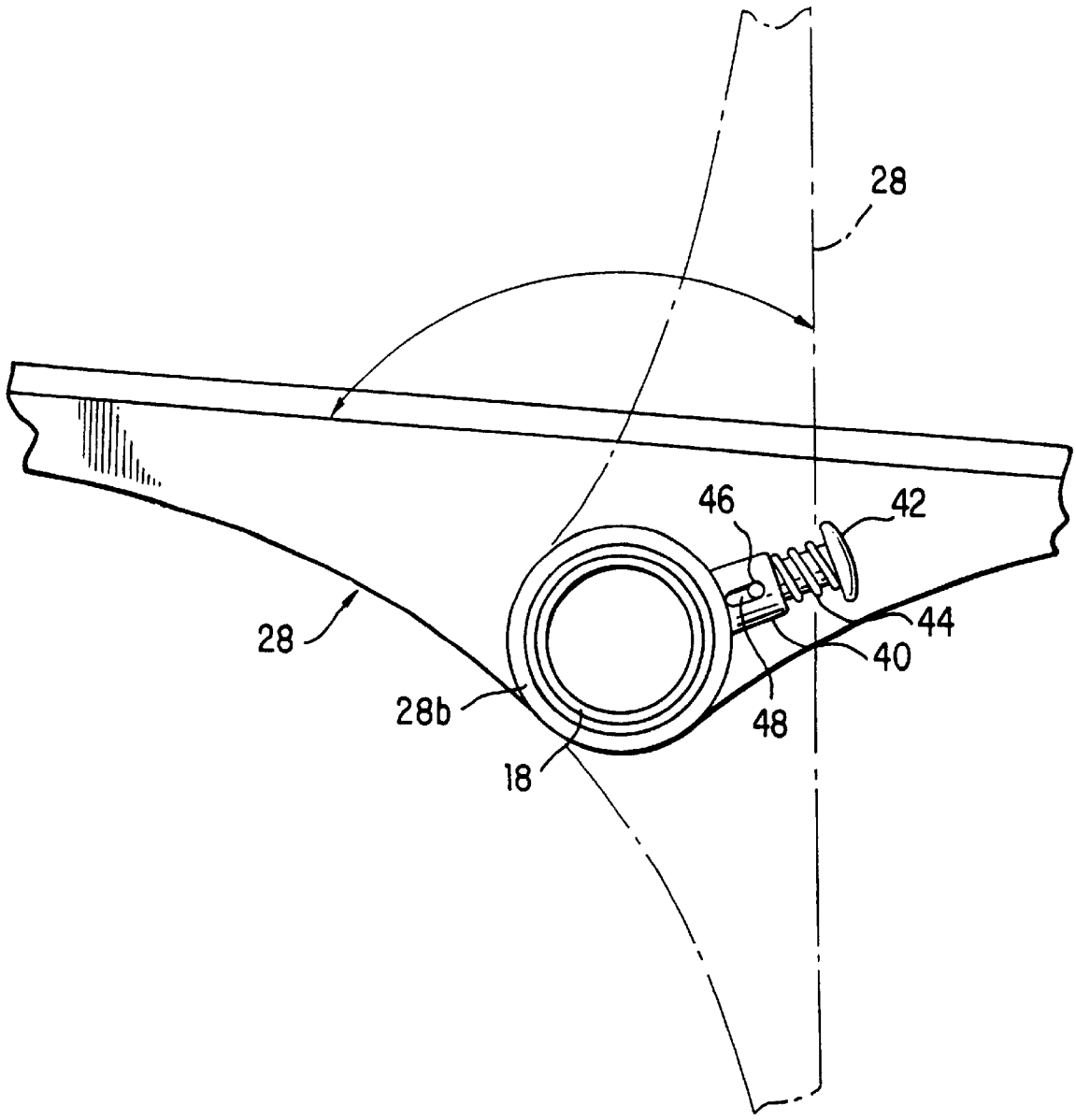
FIG. 9 is a side elevational view, showing a lock pin mechanism for locking the seat in the down position.
Figure 10:
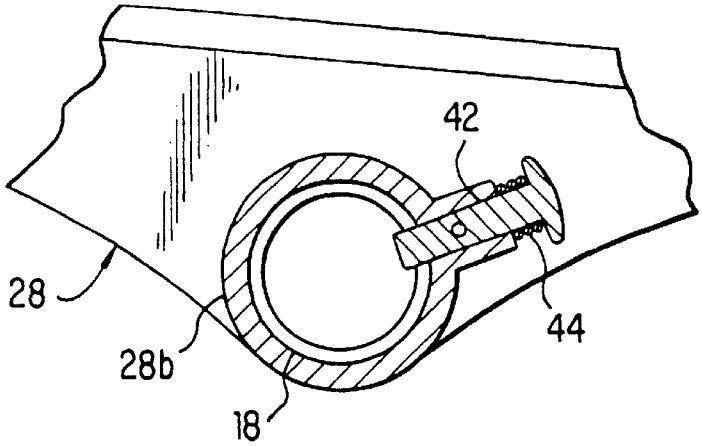
FIG. 10 is a detail cross-sectional view, similar to FIG. 9, showing the lock pin in the "locking" position.

FIGS. 6 to 8 (described above) show the seat support 28 generally schematically. FIGS. 20 to 26 show the seat support 28 in detail and, in view of the above description, are largely self-explanatory. The seat support 28 is a casting, preferably of aluminum. One may see in FIGS. 22 and 25 that the end surfaces 38*ed* and 40*ed* ("end down") of the notches 38 and 40 in the boss/flange portion 28*b* that receive the connector pin 30 are semi-cylindrical—those surfaces are of the same diameter as the connector pin, so contact stresses between the connector pin and the end surfaces are kept low when they engage. The surface 40*ed* and the part of the boss/flange 28*b* on which the surface is formed are made large to carry large loads in the seat-down position. The surfaces 38*ed* and 40*ed* share the seat-down loads. The seat-up end surfaces 38*eu* and 40*eu* may be of any shape, inasmuch as the loads are small. Small bosses 28*s* surround the holes for the screws that attach the seat 24 to the seat supports 28. No provision is made in the seat support 28 of FIGS. 20 to 26 for automatic spring-biased tilt-up of the seat or locking in the down position. The seat support of FIGS. 20 to 26 is designed for manual tilt-up. For automatic tilt-up, it need only be modified to include an attachment point for one end of a spring (see FIGS. 7 and 8).

Figure 27:
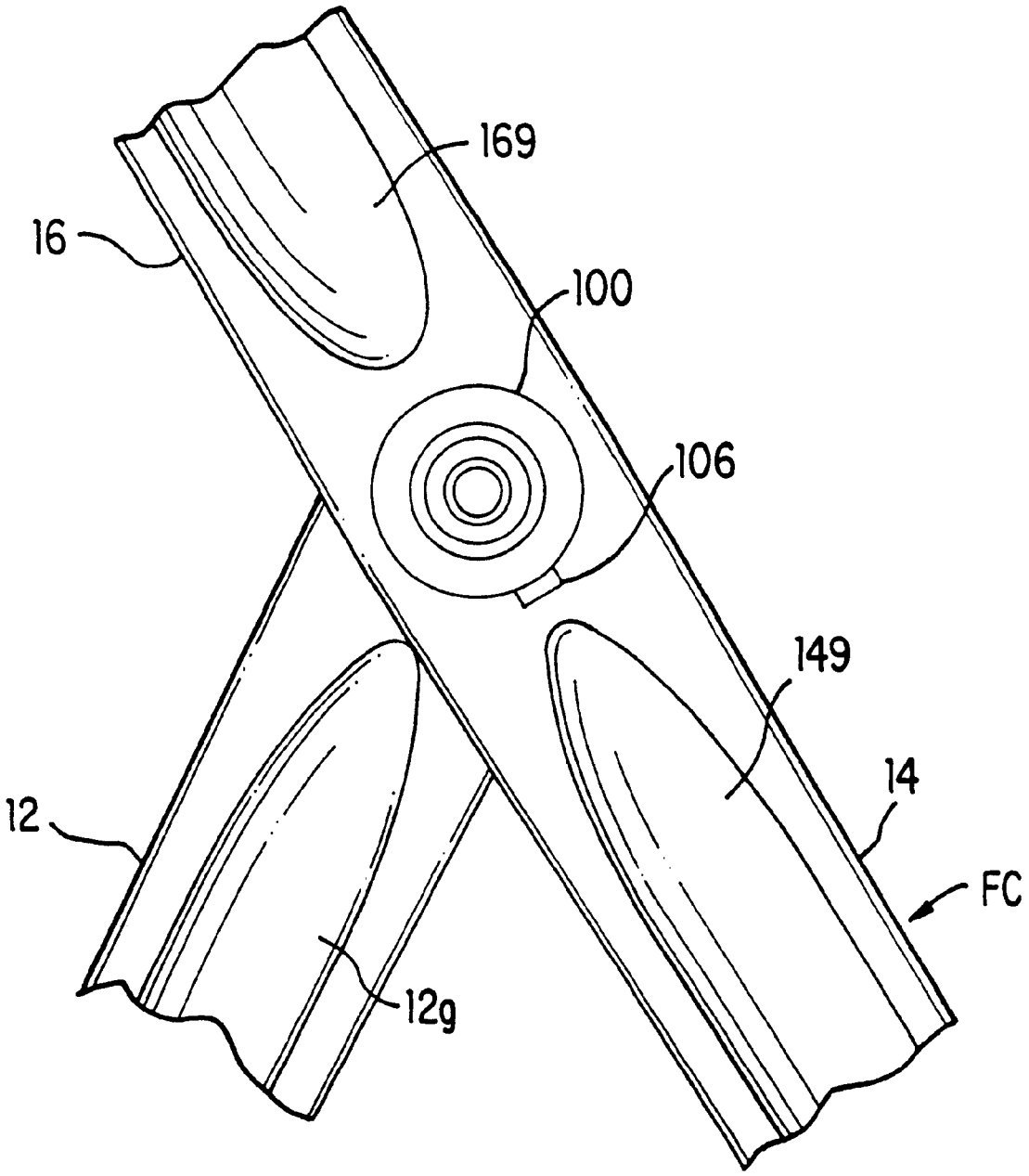
FIG. 27 is a partial elevational view of the medial aspect of the left leg/backrest support casting.
Figure 29:
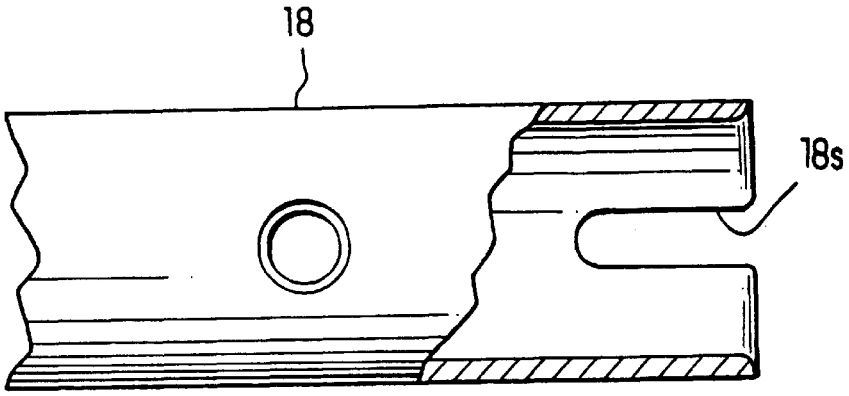
FIG. 29 is a top plan view of the left end portion of the cross-piece, showing part of it cut away.

As mentioned above, the frame castings FC provide the legs 12 and 14 and the backrest supports 16 of the chair frame and may also include armrests 122. The medial surfaces of the legs 12 and 14 and the backrest supports 16 have grooves 12*g*, 14*g* and 16*g* (see FIG. 27) over most of their lengths that render them generally channel-shaped in cross section. A shaft-like circular cylindrical boss 200 is integrally formed at the juncture of the legs and backrest support (FIGS. 27 and 28). Diametrically aligned holes 102 and 104 extend radially through the boss 100. The boss 100 is received telescopically with a close sliding fit into a portion of the end of the tubular crosspiece 18. The holes 102 and 104 accept the connector pin 30 with an interference fit, which retains the connector pin in the installed position (see FIG. 8). A rib 106 on a portion of the boss 100 fits into a slot 18*s* in the crosspiece 18 (see FIGS. 28 and 29) so as to properly orient the frame casting FC rotationally relative to the crosspiece in the proper position. The engagement between the rib 106 and the slot 18*s* also aids the connector pin 30 in carrying circumferential loads transferred from the crosspiece to the legs.

Figure 30:
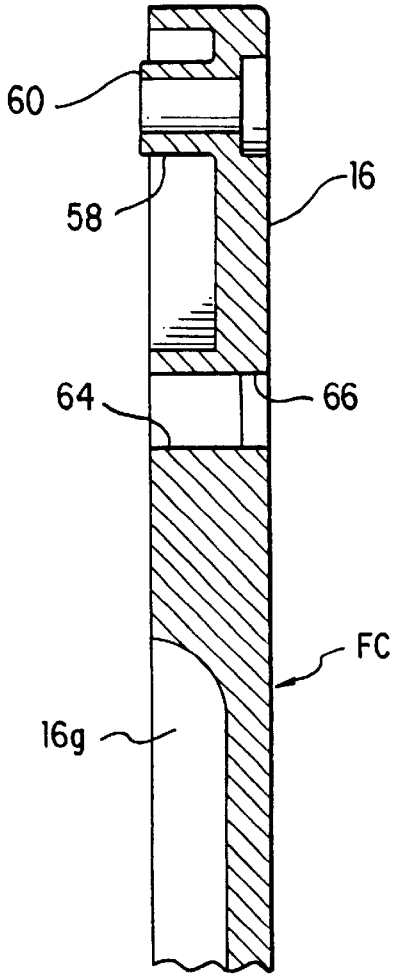
FIG. 30 is a front cross-sectional view of the upper end portion of the backrest support.

FIG. 30 shows the upper portion of the backrest support of the frame casting FC, which is described above and shown in FIGS. 15 and 16. One may observe that the arcuate flange 60 projects slightly medially from the medial face of the backrest support in order to establish a small gap between the lateral surface of the adjacent end of the backrest 50 and the medial surface of the backrest support 16.

Figure 31:
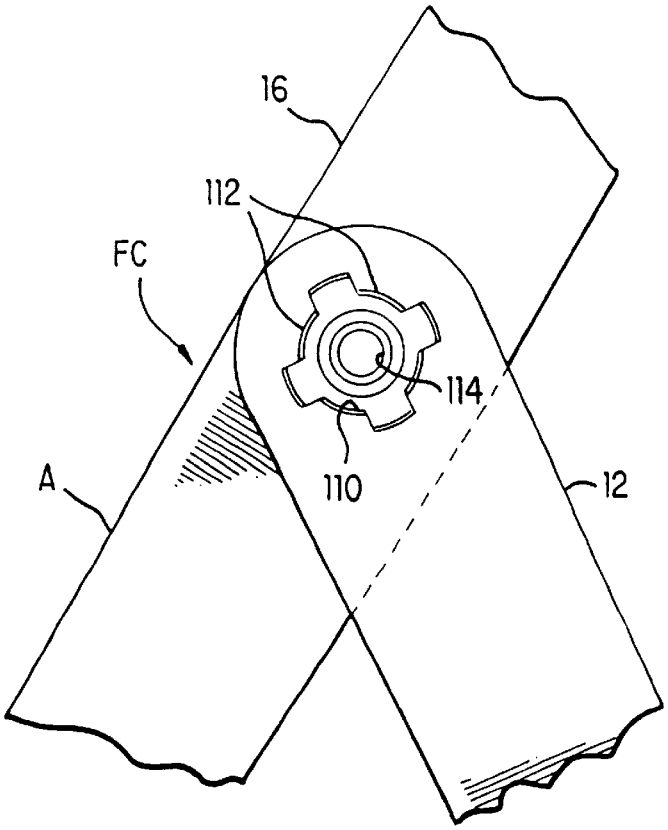
FIG. 31 is a detail view of part of the lateral aspect of the left leg/backrest support casting.

The frame casting FC includes, as shown in FIG. 31, on the lateral aspect of the juncture of the legs 12 and 14 and the backrest support 16 a recess 110 with ribs and grooves 112. A threaded hole 114 is provided at the base of the recess. The recess is configured to accept various accessories, such as ganging fittings (well-known per se) that permit the chairs to be joined side by side, support members for armrests separate from the frame castings FC, and support arms for writing tablets, which are secured to the frame casting FC by screws received in the threaded hole 114. When no accessories are installed in the recess 110, a decorative plug 116 (see FIGS. 1 and 2) is pressed into the recess.

The chair has been designed to make it easy to assemble using simple tools so that it can be shipped in disassembled condition, thus permitting significant savings in packing and shipping costs. First, the seat supports 28 (if used in lieu of the fixed seat supports 128) are slid onto the crosspiece 18. The frame castings are then partly assembled to the crosspiece 18 by inserting the bosses 100 partway but not fully into the ends of the crosspiece 18. The springs 54 are inserted into the grooves 58 in the backrest supports 16. At this time, of course, the springs are relaxed, so the leg 5411 protrudes obliquely downwardly and rearwardly with respect to the pivot axis of the backrest. The installer positions the backrest above its installed position, with the grooves 54 aligned with the legs 54/1 of the spring, and then pushes the backrest down between the springs along the line of the legs 54/1. Upon a little maneuvering, the springs will be accepted in the grooves 52 in the backrest. The installer then starts the pivot pins 62 into the threaded holes in the backrest and then pivots the backrest to approximately midway between upright and tilted back, thus loading the springs 54 and aligning the hole 66 in the backrest supports 16 with the threaded hole 69 in the backrest 50. He or she then installs the stop pins 70 in the holes 69 in the backrest. The frame castings can then be pushed fully into place on the crosspiece. The seat supports are moved into proper position axially so that the slots 38 and 40 for the connecting pins 30 are in register with the receiving holes in the crosspiece and the bosses 100 of the frame castings. The connecting pins 30 are then installed, using a hammer or mallet (because of the press-fit). At this point, the pivot pins for the backrest can be tightened and the plugs or any accessories, if used, installed in the recesses. It only remains to fasten the seat to the seat supports 26 by two screws 90 inserted through each seat support 28 (or 128) into the seat. Assembly is now complete.

What is claimed is:

1. A chair comprising a frame having a crosspiece and having a front leg, a rear leg and a backrest support attached to each end of the crosspiece;

a seat mounted on the crosspiece, a backrest; and a pair of backrest-mounting mechanisms mounting the backrest on the backrest supports for pivotal movement about a horizontal pivot axis between an upright position and a rearwardly inclined position, each backrest-mounting mechanism attaching one side of the backrest to the backrest support and including a pivot pin attaching the backrest to the backrest support for pivotal movement, the pivot pin passing through a hole in the backrest support and extending into a threaded hole in the backrest, the pivot pin having a threaded portion threaded into the backrest and a head portion engaging the backrest support so as to affix the backrest to the backrest support, a spring engaged between the backrest and the backrest support and biasing the backrest to an upright position, and a stop pin affixed to one of the backrest and the backrest support and received in a stop groove in the other of the backrest and the backrest support, the stop pin being engageable with end stop surfaces of the stop groove so as to limit the range of pivotal movement of the backrest and establish the upright and inclined positions of the backrest.

2. A chair according to claim 1, wherein the spring is a coil torsion spring having a coil and projecting leg at each end of the coil, the coil being received around the pivot pin, one leg being received in a cavity in the backrest and the other leg being received in a cavity in the backrest support.

3. A chair according to claim 2, wherein the cavity in the backrest is in a laterally outwardly facing surface of the backrest and the cavity in the backrest support is in an inwardly facing surface of the backrest support abreast of the outwardly facing surface of the backrest support.

4. A chair according to claim 1, wherein the stop pin is affixed to the backrest, the stop groove is in the backrest support, and the backrest support has a hole opening into the stop groove and aligned with a hole in the backrest that receives the stop pin so that the stop pin can be installed from the outer side of the backrest support.

5. A chair according to claim 1, wherein the seat is affixed to a pair of laterally spaced-apart seat supports mounted on the crosspiece.

6. A chair according to claim 5, wherein the seat supports are affixed to the crosspiece.

7. A chair according to claim 5, wherein the seat supports are pivotally mounted on the crosspiece so that the seat can be tilted up.

8. A chair according to claim 7, wherein for each seat support a connector pin extends completely through the crosspiece and includes portions projecting outwardly from opposite sides of the crosspiece, the projecting portions are received in stop slots in the seat support and are in sliding engagement with side surfaces of the stop slots to retain the seat support on the crosspeice against lateral movement and are engageable with end stop surfaces of the stop slots so as to establish the up and down positions of the seat supports.

9. A chair according to claim 8, wherein the lock pin is received in a tubular boss on a flange portion of the seat support and is movable into a hole in the crosspiece to lock the seat in a down position.

10. A chair according to claim 7, and further comprising a spring coupled between the crosspiece and at least one of the seat supports and biasing the seat to pivot to the tilted-up position.

11. A chair according to claim 7, wherein the crosspiece is tubular, the front leg and the back support at each end of the crosspiece are portions of a monolithic casting, each casting includes a mounting boss that is received within an end-portion of the crosspiece and is affixed within the crosspiece by a connector pin that extends through mating holes in the crosspiece and the mounting boss and includes portions projecting outwardly from opposite sides of the crosspiece, the-projecting portions are received in stop slots in the seat support and are in sliding engagement with side surfaces of the stop slots to retain the seat support on the crosspiece against lateral movement and are engageable with end stop surfaces of the stop slots so as to establish the up and down positions of the seat supports.

12. A chair according to claim 11, wherein each casting further includes the rear leg.

13. A chair according to claim 11, wherein each casting further includes an arm rest.

14. A chair according to claim 11, wherein the mounting boss of each casting includes an axial rib that is received within a slot in the crosspiece so as to further affix the casting to the crosspiece against rotation.

15. A chair according to claim 11, wherein each casting further includes a socket opening outwardly and adapted to receive an accessory.

16. A chair according to claim 5, wherein one of the seat supports has a lock pin mechanism for locking the seat in a down position.

17. A chair according to claim 1, wherein the crosspiece is tubular, the front leg and the back support at each end of the crosspiece are portions of a monolithic casting, and each casting includes a mounting boss that is received within an end portion of the crosspiece.

18. A chair according to claim 17, wherein the mounting boss of each casting is affixed within the crosspiece by a connector pin that extends through mating holes in the crosspiece and the mounting boss.

19. A chair according to claim 18, wherein the mounting boss of each casting includes an-axial rib that is received within a slot in the crosspiece so as to further affix the casting to the crosspiece against rotation.

20. A chair according to claim 19, wherein the lock pin is normally held extended by a spring in a release position.

21. A chair according to claim 19, wherein the force of a tilt-up spring on at least one of the seat supports acts through the lock pin which is thereby captured by friction in the hole in the crosspiece.

22. A chair according to claim 18, and further comprising for at least one of the seat supports a tension coil spring coupled between the connector pin and the seat support and biasing the seat to pivot to the tilted-up position.

23. A chair according to claim 17, wherein each casting also includes the rear leg.

* * * * *

UNITED STATES PATENT AND TRADEMARK OFFICE

CERTIFICATE OF CORRECTION

PATENT NO. : 6,481,789 B1
DATED : November 19, 2002
INVENTOR(S) : Ambasz, Emilio It is certified that error appears in the above-identified patent and that said Letters Patent is hereby corrected as shown below:

Column 7,
Line 63, "5411" should read -- 54/1--

Column 9,
Line 31, "the-projecting" should read -- the projecting --

Column 10,
Line 23, "an-axial" should read -- an axial --

Signed and Sealed this

Twenty-fifth Day of March, 2003

JAMES E. ROGAN
*Director of the United States Patent and Trademark Office*